US006549108B2

(12) United States Patent
Fausch

(10) Patent No.: US 6,549,108 B2
(45) Date of Patent: Apr. 15, 2003

(54) RELAY

(75) Inventor: Werner Fausch, Buchs (CH)

(73) Assignee: Elesta relays GmbH, Bad Ragaz (CH)

( * ) Notice: Subject to any disclaimer, the term of this patent is extended or adjusted under 35 U.S.C. 154(b) by 0 days.

(21) Appl. No.: 09/821,207

(22) Filed: Mar. 29, 2001

(65) Prior Publication Data

US 2001/0045878 A1 Nov. 29, 2001

(30) Foreign Application Priority Data

Apr. 3, 2000 (CH) ..... 0648/00

(51) Int. Cl.[7] ..... H01H 67/02
(52) U.S. Cl. ..... 335/129; 335/130; 335/132
(58) Field of Search ..... 355/78–86, 124, 355/128, 129–131, 202

(56) References Cited

U.S. PATENT DOCUMENTS

| | | | | |
|---|---|---|---|---|
| 2,115,748 A | * | 5/1938 | Reisner | 335/131 |
| 3,555,230 A | | 1/1971 | Deck | |
| 3,735,294 A | * | 5/1973 | Altmann | 335/134 |
| 5,568,108 A | | 10/1996 | Kirsch | |
| 5,945,900 A | * | 8/1999 | Shibata et al. | 335/234 |
| 6,034,582 A | | 3/2000 | Fausch | |
| 6,081,177 A | | 6/2000 | Fausch | |

FOREIGN PATENT DOCUMENTS

| | | |
|---|---|---|
| AT | 379254 | 12/1985 |
| DE | 2219315 | 11/1973 |
| DE | 2817036 | 10/1979 |
| DE | 19540739 A1 | 1/1997 |
| DE | 19600314 A1 | 7/1997 |
| DE | 19816878 A1 | 10/1999 |
| EP | 0938119 A1 | 8/1999 |
| EP | 0938120 A1 | 8/1999 |
| EP | 0954001 A1 | 11/1999 |
| FR | 2423855 | 11/1979 |
| FR | 24238855 | 11/1979 |
| FR | 2612685 | 9/1988 |
| WO | WO 92/21133 | 11/1992 |

OTHER PUBLICATIONS

Search Report for Swiss Patent Application No. 2000 0172/00.

Search Report for Swiss Patent Application No. 2000 0648/00.

* cited by examiner

*Primary Examiner*—Lincoln Donovan
*Assistant Examiner*—Tuyen T. Nguyen
(74) *Attorney, Agent, or Firm*—Williams A. Simons; Wiggin & Dana

(57) ABSTRACT

A safety relay comprising a separating wall, an electromagnetic drive located on a first side of the separating wall comprising a coil with core and yoke, the coil being connectable to a control current, the core being oriented parallel to the separating wall, and a movable armature, a comb located on a second side of the separating wall capable of moving parallel to the separating wall by means of the armature, and a row of several contacts located on the second side of the separating wall actuated by the drive comb, each of the contacts comprising at least two contact elements arranged on an electrically insulating carrier part each of the contacts being connected with a current connection element, at least one of the contact elements being formed by an elongated contact spring arranged between the comb and the separating wall, the contact spring being arranged with a spring longitudinal axis crosswise to the direction of the movement of the comb, forcibly guided by the comb and by a spring foot at one end of the contact spring sitting rigidly in the carrier part, and being provided with a contact head at an end lying opposite the spring foot, the end being movable.

19 Claims, 4 Drawing Sheets

RELAY

BACKGROUND OF THE INVENTION

1. Field of the Invention

The invention concerns a safety relay with at least one electromagnetic drive, which comprises a coil with a core/yoke that can be connected to a control current and a movable armature. The relay also comprises a comb that can be moved by means of the armature and several contacts arranged on an electrically insulating carrier part. The drive is arranged on one side of a separating wall; comb and contacts are on the other side of the separating wall. The invention particularly concerns a twin relay of the aforementioned type. The twin relay is a safety relay with two electromagnetic drives. These drives are arranged on one side of a separating wall. Two combs and two rows of contacts are arranged correspondingly on the other side of the separating wall.

2. Brief Description of Art

A twin relay, which is approximately 15 mm high, 65 mm wide, and 76 mm long, and the structural height of which is formed by two planes, is described in WO 99/54,905. In one of the planes, for example on the side of the connections, two drive systems (opposite-poled sliding armatures) are accommodated. The contact sets are arranged in the other plane. The contact sets each are formed by two contacts individually driven by one of the drives that are independent of one another, and these contacts are connected internally in series. The contacts are formed by one or two contact springs. If a contact is formed by two contact springs, then the active or the passive contact spring extending over the entire width or length of the relay is clamped in the center in a chamber separating wall, and possesses a contact head on both ends. This contact head cooperates with a contact spring, which has a terminal connection on the outside of the relay. If the individual contact is formed of a single contact spring only, then the latter is forcibly-commutated together with the comb and its contact head cooperates directly with the contact head of the contact spring of the other contact of the contact set. This contact spring of the second contact is in turn forcibly-commutated together with a second comb. The two combs each move in opposite directions. The contact springs extend parallel to a separating wall between the two planes. The prior art document is silent with respect to the position and configuration of the drive with armature and comb.

Nowadays a relay must meet two partially contradictory requirements. These requirements must be considered in the development of new relays in order to be competitive in the marketplace. The first requirement is that relays must be made smaller. On the other hand it is required of the relays that they be durable and reliable. In a safety relay which meets EN (European Standard) 50205, the air paths and leakage paths between control contact and load contact comply with the requirements of standard IEC 61810-5 and IEC 664-1. The contents of these standards are known to the person skilled in the art and are included by reference. Depending on the voltage, the degree of contamination and the field of application, the known distances between conductive components of the different load contacts must be maintained. In addition, the forced commutation of the contacts further serves for purposes of safety.

In accordance with the present invention, a forcibly-commutated relay is a relay in which the contacts are forcibly-commutated with a common movable comb that is connected with the drive and in which at least one working contact and one resting contact are provided. Forcibly commutated here means that each time a contact element abuts a fixed stop, a movable contact spring cooperating with this contact element engages in the comb in such a way that it is forcibly moved together with the movements of the comb. With this constructive measure, it is ascertained that in case a contact is welded, either the welded contact breaks or the comb cannot be moved and thus the other contacts, including the resting contact, also remain in the position given by the welded contact.

BRIEF SUMMARY OF THE INVENTION

Thus, the object of the invention is to provide a safety relay of compact and simple construction, with which reliable, durable operation is assured. Preferably the relay is miniaturized. In addition the relay shall be easy to assemble and optimally adjustable.

The adjustment of the contacts forms an important aspect for assuring safety and durability of a relay. A sufficient adjustment of the contacts is more difficult to obtain the smaller the relay is and the smaller the clearances relative to the force equilibrium of the drive/spring and the 3-dimensional distances are selected. Thus high requirements are to be placed on adjustability in the case of a miniaturized relay.

The adjustability of the safety relay or the twin relay of the present invention is achieved in that the contact springs are arranged between the comb and the separating wall separating the drive side from the contact side.

The safety relay has at least one electromagnetic drive, which comprises at least one coil with a core/yoke that can be connected to a control current and a movable armature. This drive is arranged on one side of a separating wall which extends parallel to the core. A comb that can be moved parallel to the separating wall by means of the armature and a row of several contacts which are arranged on an electrically insulating carrier part are located on the other side of the separating wall. The contacts are comprised of at least two contact elements and can be actuated by the drive. At least one of the contact elements is connected with a current connection element, for example a pin on the outer side of the relay. Likewise, at least one of the contact elements is formed by an elongated contact spring. The longitudinal axis of this contact spring is arranged transverse to the direction of motion of the comb and extends advantageously parallel to the plane of the separating wall. The contact spring is forcibly-commutated by the comb. The contact spring with its spring foot on one end is accomodated firmly in the carrier part. On its opposite movable end it is provided with a contact head. For an optimal construction of the relay, the contact springs are arranged between the comb and the separating wall. With this construction, the length of the armature can take up the entire height of the relay, and a relatively large comb path is achieved with relatively small structural height.

Advantageously, a removable outer wall of the contact chamber on the comb side of the contact spring that lies opposite the separating wall for closure of the relay. This allows one to insert the comb into the carrier part after introducing the contact elements, and holding it in its catching position by means of the outer wall of the chamber. If the contacts can be arranged in a functional manner in the opened relay, it is assured by this arrangement that the contacts can be optimally adjusted. When adjusting the contacts, the contacts are firmly secured in the carrier part, are not in engagement with the comb, and are freely accessible from the open outer wall of the chamber. In order to control the adjustment, the comb can be temporarily inserted with the relay still open. Only after the correct adjustment has been controlled, the comb is definitively inserted and the outer wall of the chamber is put in place, and thus the relay is sealed.

Preferably, the individual contacts are separated from one another by chamber walls. Advantageously, the comb is formed by a longitudinal bar extending through cutouts in the chamber walls. This longitudinal bar can be arranged in the vicinity of the contact springs and is engaged with the contact springs by means of suitable formations on the bar. Due to the drive arrangement, the longitudinal bar is advantageously arranged in the center between the outer edges of the relay or relay part. Shields are provided on at least three sides of the longitudinal bar, which are arranged approximately parallel to the chamber walls and extend beyond the sides of the longitudinal bar, in order to elongate the air and leakage paths between contact elements of adjacent contacts in the region of the through-passages of the bar. A labyrinthine extension of the air and leakage paths is achieved by overlapping the chamber walls with the shields.

Preferably, the engagement portion of the contact spring on the comb has a distance to the bar axis of the comb, parallel to the longitudinal axis of the spring. As a result of such distance, the longitudinal bar of the comb can be arranged centrally, while the contact spring engages the comb at a selectable distance to the spring foot and the contact head.

Preferably, the dimensions of the drive and the contacts are selected to correspond with one another, by providing that the totality of the chambers housing the contacts actuated with a drive leave approximately the same dimensions in two directions as the coil assigned to the contacts. Thus the chambers and the coil having practically the same extensions, the available space is optimally utilized. Resulting from its considerable length the coil may be selected as a relatively high-ohm coil, despite its reduced height.

The chamber walls for separating adjacent chambers may be formed on the carrier part or protruding from the outer wall of the chamber. Advantageously, they are formed on both parts. Thus, air and leakage paths are lengthened by an overlapping of the chamber walls.

Preferably, at least one portion of the contacts is provided with two independent terminal elements. Contacts having only one terminal element extending to the outside are appropriate for twin relays. These contacts are connected in series with a second contact, which is actuated by a second coil. In the ordinary single relay, all of the contacts have two terminal elements, or three in the case of double-throw contacts, which extend to the outside of the relay. Such contacts are particularly suitable as control contacts, even in twin relays.

In a further advantageous embodiment of the invention, the contact springs between their contact head and the spring foot each have a projection with a comb attachment protruding away from the separating wall towards the comb side. The contact spring is forcibly engaged with the comb by the comb attachment. A lateral protrusion on the contact spring allows to insert the comb between the head end and the foot end of the contact spring next to the projection. The contact spring may be notched in the region adjoining the protrusion for guiding the comb therethrough. Thus, the comb may be shaped mirror symmetrically with respect to a plane through the bar axis extending perpendicularly to the separating wall. The projection then engages in one of the two formations provided for engagement. This permits the use of a uniform comb even in the case of a twin relay of the type described below.

Advantageously, the contact spring is engaged with the comb at a comb attachment, which is located at a distance from the mechanical longitudinal axis of the spring. The distance to the mechanical longitudinal axis causes a twisting of the contact spring when the contact is connected, which acts favorably on the life-span of the contact head and thus on the durability of the relay.

Preferably, the contact head is attached to the spring by its center at a preselected distance beneath the mechanical longitudinal axis of the contact spring. This also causes a twisting of the spring and a favorable effect on the contact head when the contact is connected. The preselected distance is preferably smaller than the distance between the comb attachment and the longitudinal axis of the spring.

In the direction of the longitudinal axis of the spring, the distance of the comb attachment from the spring foot is preferably about double its distance from the center of the contact head, in order to achieve good guidance and sufficient length of movement of the contact head.

Such a relay with six contacts can be made very small while fulfilling the requirements of the standards indicated initially. The terminal ports are located on the side of the contacts and the drive is arranged above the contacts and extends over practically the entire length of the relay. The relatively large space available for the winding allows an efficient drive with small coil losses. On the side of the armature, on the relay end, terminal ports are provided for the coils.

The advantages stated above also apply to a safety relay with two electromagnetic drives, for example a twin relay. Twin relays have a coil with a core that can be connected to a control current and a movable armature for each drive. The coils are preferably aligned the same way, so that the armatures are located on the same side. The drives are arranged on one side of a separating wall which extends parallel to the cores, while each armature extends across the separating wall. Two combs movable parallel to the separating wall, and two rows of several contacts which are arranged on an electrically insulating carrier part, are arranged next to one another on the other side of the separating wall. The contact springs are arranged with their longitudinal axis parallel to the separating wall. The combs are driven independently of one another, each by one of the armatures. At least two of the contacts actuated thereby independently of one another are joined via a common contact element.

According to the invention, the contact springs are arranged between the comb and the separating wall. The contacts, which have only one terminal element and are connected with a second such contact by means of a common contact element, are preferably arranged on the end of the comb opposite the armature. In this way, preferably a center region arranged underneath the relay and adjacent to at least one edge of the relay, is free of terminal elements. This permits to arrange contact lines to the terminal elements of the contacts having two terminal elements, the contact lines extending in the direction of motion of the comb underneath the relay.

Advantageously, in the case of the contact springs of the contacts which are joined with one another by a common contact element and forcibly commuted by the combs, the spring feet are arranged at ends turned away from one another. Appropriately, the contact heads are arranged between the contact feet of the two contact springs driven independently and connected to a switching unit at ends of the contact springs which are turned toward one another. This arrangement has the advantage that the movable contact springs have the largest possible length and the stationery common contact element can be formed as small as possible. A twin relay of the above-described construction has twice the area of the single relay.

DETAILED DESCRIPTION OF THE INVENTION

As used herein, "contact elements" refers to the contact spring, the fixed contact element in the single or twin relay, and the common contact element in the twin relay of the present invention.

Figure 1:
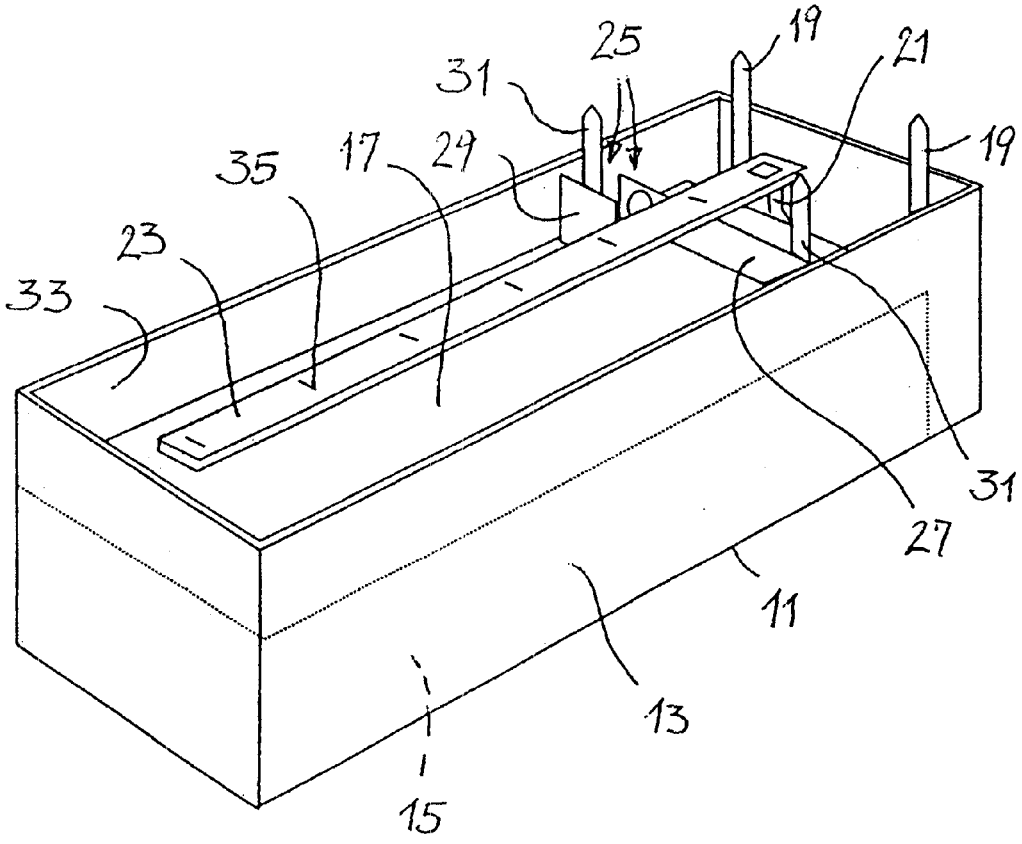
FIG. 1 is a schematic, perspective view of a relay constructed according to the invention.

In FIG. 1 only those elements which are necessary for the understanding of the relay according to the invention are depicted. Relay 11 has a drive 15 in a drive region 13 shown bounded by the dotted line. The drive 15 is located on a first side of an essentially planar separating wall 17. Drive 15, as usual, has a coil connected to a control current by means of two control terminal connection pins 19 and can move a comb 23 by an armature 21. Working contacts and control contacts are arranged on the second side of the separating wall 17. In FIG. 1 a single pair 25 of contact elements with a contact spring 27 engaged in comb 23 and an immovably arranged second contact element 29 represents a multiple number of contacts. Both contact elements 27, 29 each have a current connection element, for example a terminal pin 31.

The core and yoke of the coil of drive 15 is arranged parallel to separating wall 17. The armature 21 is arranged on a short side of relay 11 and extends upwardly to the other side of separating wall 17 and is engaging comb 23. Contact elements 27, 29 are arranged directly adjacent to separating wall 17 and attached to a carrier part 33 forming the separating wall 17. Comb 23 is arranged on the side of the contact elements 27, 29, facing away from the drive. Thus with the relay 11 turned upside down and having the terminal pins extend into the air the comb is located on top. When the relay is assembled this arrangement allows the insertion of the contacts 25 into the carrier part 33 already provided with the drive and their adjustment and inspection prior to engaging the comb 23 with the contact springs 27. In the comb 23 slot 35 is provided, in which a projection protruding from contact spring 27 in the direction of comb 23 engages. In FIG. 1, for illustration purposes six slots 35 are depicted, so that the contact springs 27 can be moved with the comb 23.

Figure 2:
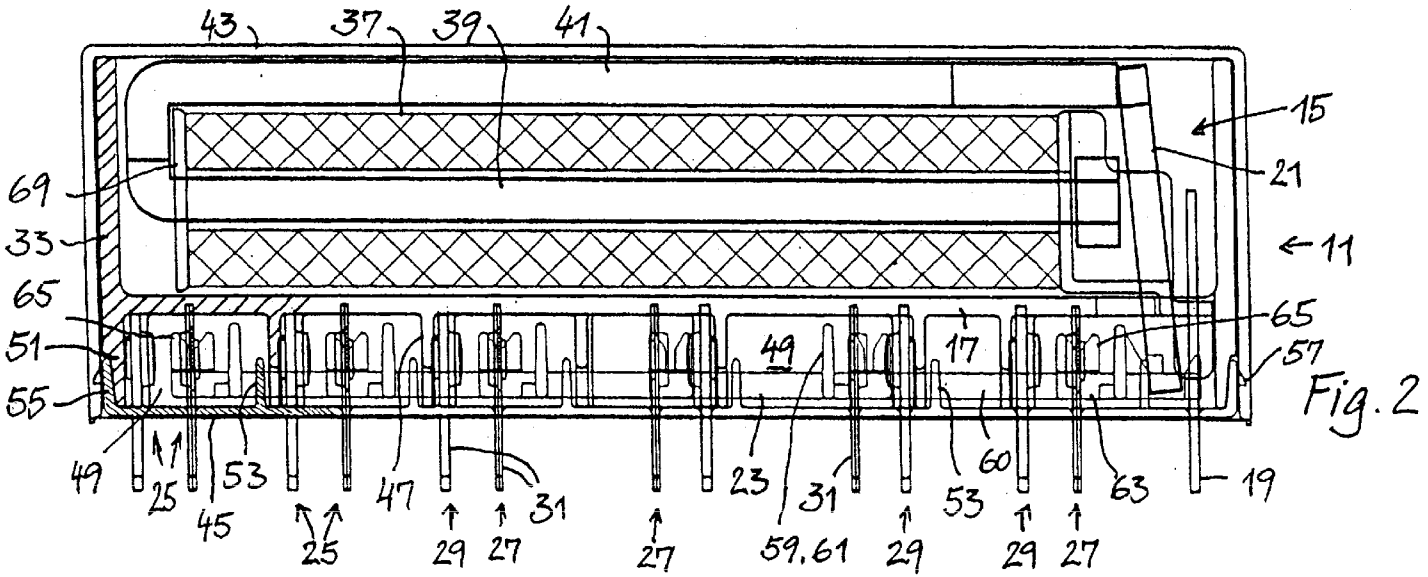
FIG. 2 is a section through coil and contacts of a relay with six contacts.

In FIG. 2, there is illustrated a coil 37 with a core 39 and a yoke 41, an armature 21, a carrier part 33 with a separating wall 17, as well as contact springs 27 and stationery contact elements 29. Further, comb 23 is shown engaged with the armature 21 and the contact springs 27. All of this is enclosed in a housing which is comprised of a cover 43 and a bottom part 45. These are hooked inside one another. Carrier part 33 forms an uptake for receiving drive 15 on one side of the separating wall 17. Chambers 49 for the contacts 25 which are separated from one another by chamber walls 47 are formed on the other side of separating wall 17. The chamber walls 47 and a peripheral wall 51 surrounding all of chambers 49 define all dimensions of the chambers. The bottom part 45 abuts with its inner side the front sides of the chamber walls 47 and the peripheral wall 51. The bottom part 45, however, is provided in turn with chamber ribs 53, which come to lie directly next to chamber walls 47 when relay 11 is sealed. A bottom edge rib 55 comprises the peripheral wall 51 and is engaged in cover 43 by nose pieces 57. Cover 43 in turn encloses all five sides of relay 11, which are not covered by bottom part 45, as well as bottom edge rib 55.

The chamber ribs 53 and the chamber walls 47 together form a labyrinthine extension of air and leakage paths between the contact elements 27, 29 in adjacent chambers 49. In places where the comb 23 extends through the chamber walls 47 and the chamber ribs 53, only a shortened air and leakage path would be formed, if this path were not extended by a shield 59 at the comb. Shield 59 protrudes over a longitudinal bar 60 of the comb 23 along three sides. The bar extends through the openings in the chamber walls and the chamber ribs. On the fourth side, i.e., the side facing toward the bottom part 45, for space reasons it is not desired that the shield 59 extend beyond the longitudinal bar 60. Thus, the shield 59 is formed in an L-shape where necessary and covers the contact spring 27 together with a shield part 61 arranged to extend parallel to the bottom part 45, so that a path elongation is achieved there also.

Positive catches 65 are formed on the shield parts 61 or like tabs 63 formed on the comb 23. The positive catches 65 engage catch projections 67 (see FIG. 5) formed at the contact spring 27 from two sides, so that the contact spring 27 must follow each movement of the comb 23. The shield parts 61 are arranged symmetrically with respect to the longitudinal bar 60 of comb 23 in order to uniformly extend the air and leakage paths on both sides of the longitudinal bar. The symmetrical arrangement permits the use of a uniform comb for both relays of a twin relay as illustrated in FIG. 6.

Returning to FIG. 2, armature 21 extends through an opening in the separating wall 17 up to the direct vicinity of bottom part 45. Its free end rests in a recess in comb 23. Coil 37 is wound on a coil carrier 69, which is penetrated by core 39. The yoke 41 and the core 39 are manufactured together from one piece. Terminal pins onto which is connected the coil winding wire are provided on the coil carrier 69. The terminal pins project from the housing through openings in the bottom part 45.

Figure 3:
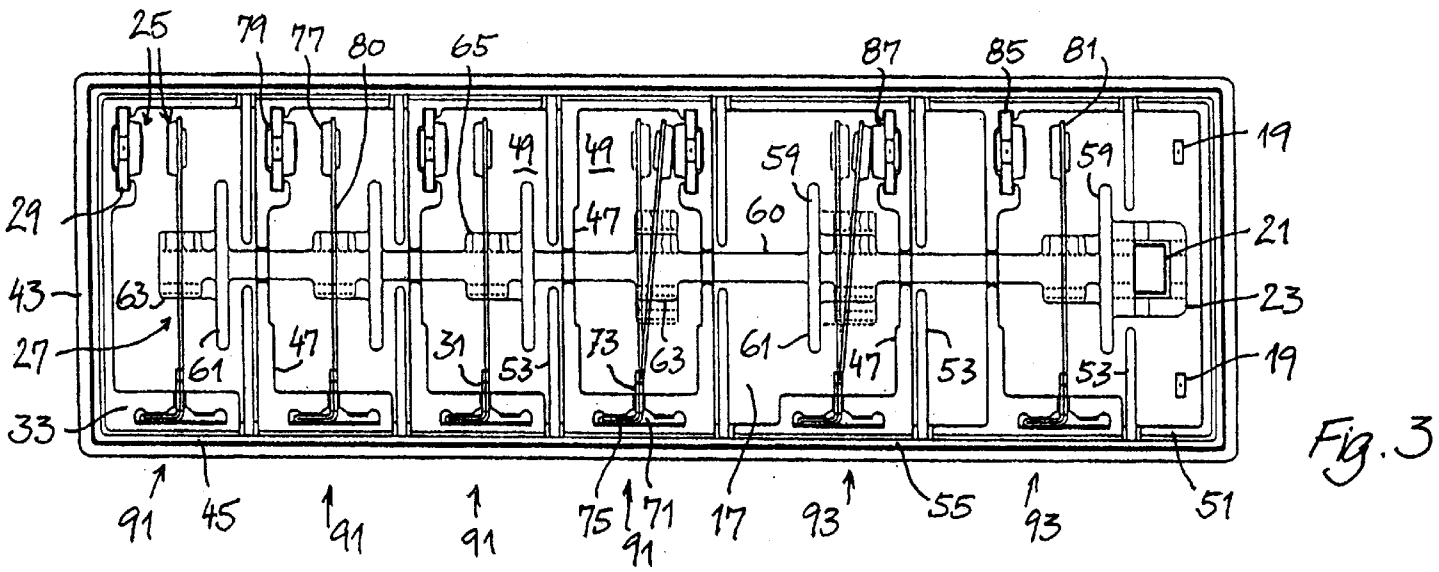
FIG. 3 is a view of the relay from underneath.

As depicted in FIG. 3, contact elements 27, 29 are seated at clamping regions 71 provided in carrier part 33. The contact springs 27 are folded once at the spring foot 73 and bent by 90° in the doubled region. They are inserted into the pocket-like clamping region 71 in carrier part 33 with this angular part 75 from the comb side, that is from the open bottom. Likewise, the rigid contact element 49 is inserted into a receptacle in the shape of a pocket 79. The terminal pins project counter to the direction of insertion of the contact elements 27, 29, towards the bottom part 45 which can be placed on carrier part 33. In the bottom part, corresponding holes for the pin are provided.

Figure 5:
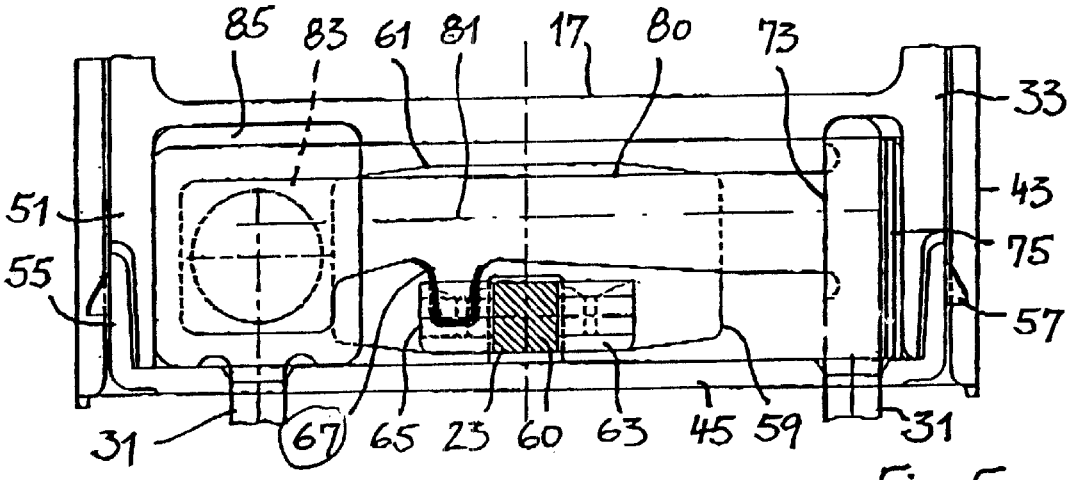
FIG. 5 is a detail of a sectional drawing through the relay according to FIG. 4.
Figure 4:
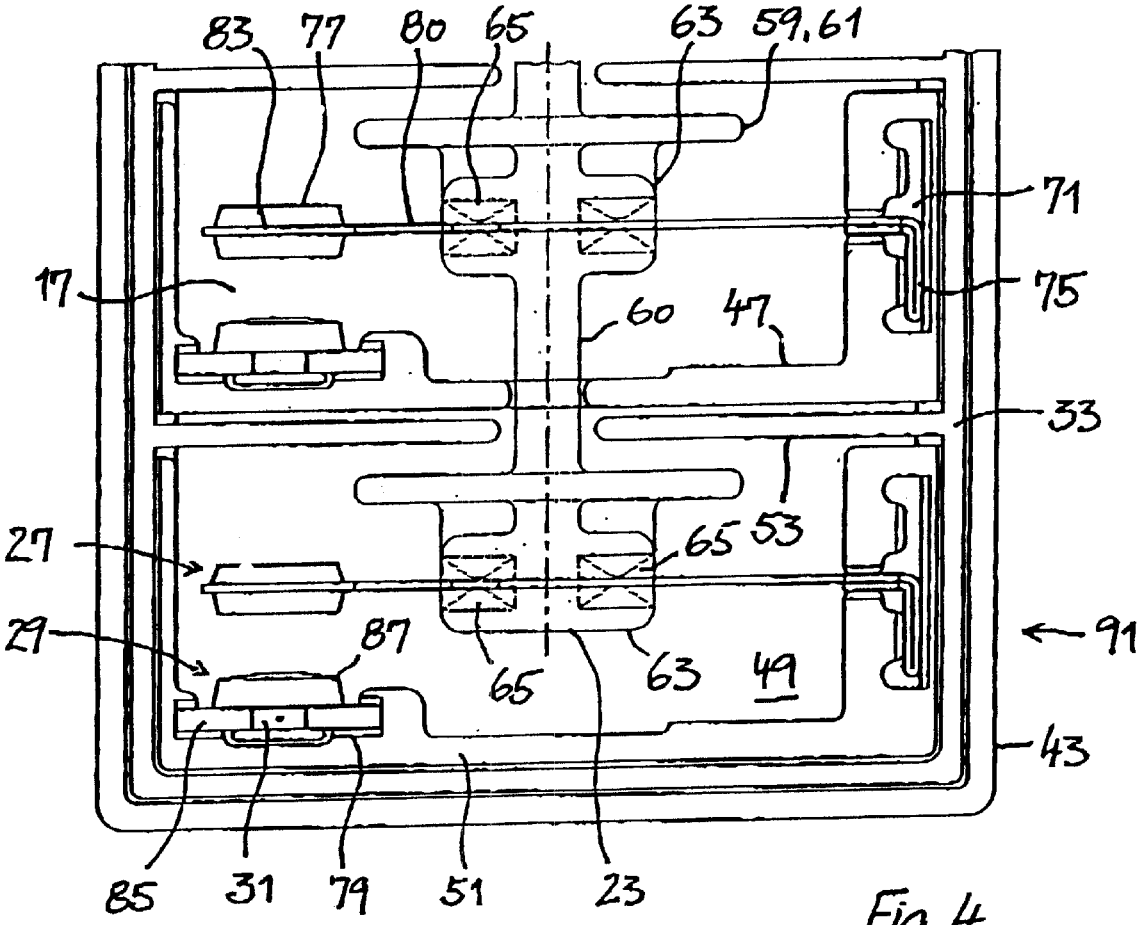
FIG. 4 is a detail of the view according to FIG. 3, but having a symmetrical comb.
Figure 6:
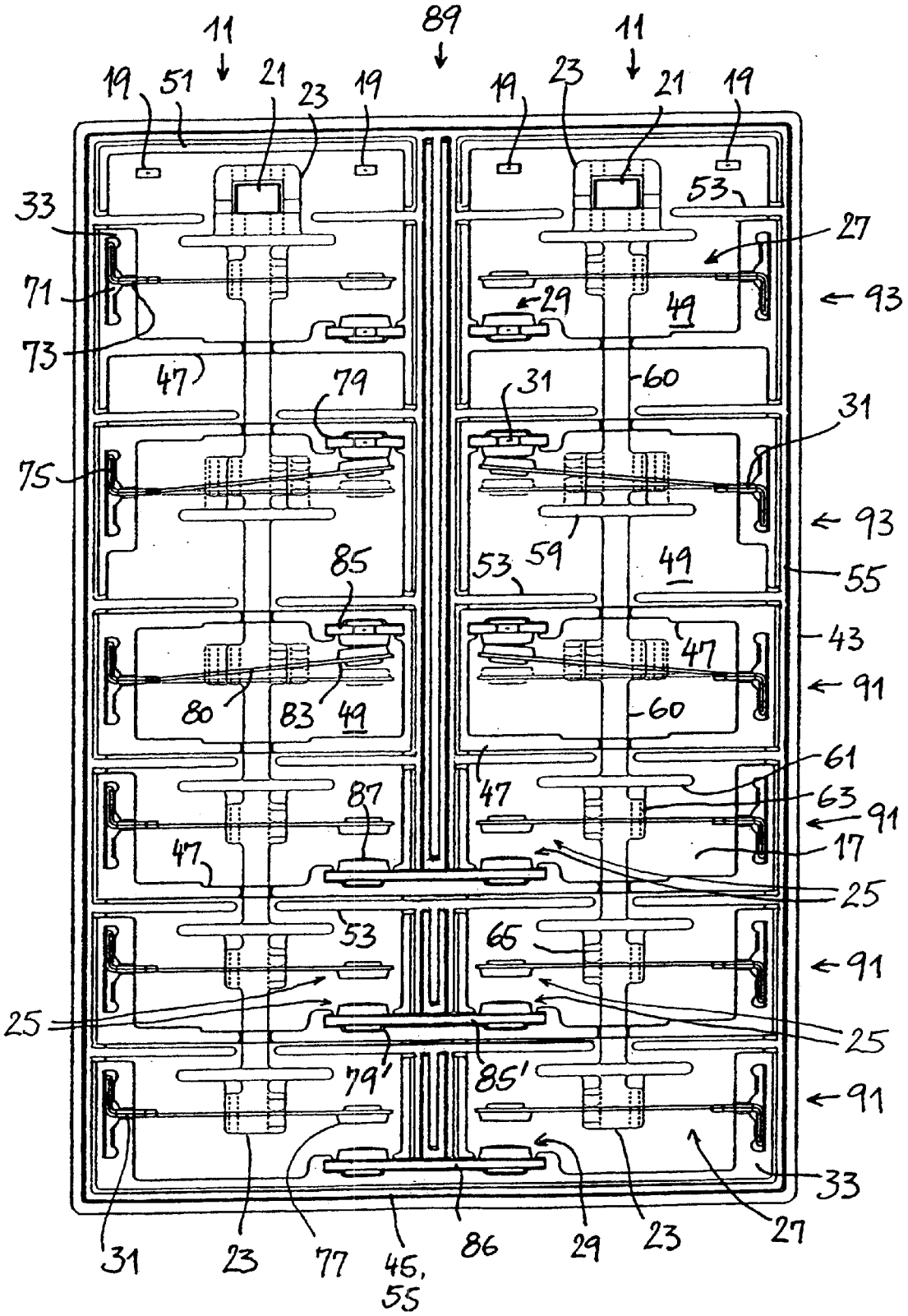
FIG. 6 is a view from underneath of a twin relay according to the invention.

An advantageous configuration of the contact springs 27, the fixed contact elements 29 and the comb 23 is illustrated in FIGS. 4 and 5. The comb 23 is shaped symmetrically, so that the same comb 23 can be used both in the relay constructed as shown as well as in a relay designed in a symmetrical configuration. Contact spring 27 is also formed symmetrical relative to contact head 77. The preformed head part of a contact head rivet is arranged on one side of contact spring 27 and the hammered head part is arranged on the other side of contact spring 27. The body of the contact spring 27 is made of a sheet metal that is preferably cut into an E-shape. The E-shape is formed by the spring part 80 (along axis 81) and the three projections extending transversely to the longitudinal axis of the spring part 80, namely the contact head 83 (which is widened relative to spring part 80), the catch projection 67, and the spring foot 73. The distance between the spring part 80 and the separating wall 17 is specified by the spring foot 73. The projection 67 is arranged in close vicinity to the head. Longitudinal bar 60 of the comb 23 extends between the spring foot 73 and the projection 67. The comb 23 is engaged with the positive catches 65 by projection 67. When the contact is opened, a twisting of the spring part 80 is effected by the actuation of the contact spring 27 via the catch projection 67 which is arranged asymmetrically with respect to the longitudinal axis 81. The twisting of the spring part is a result of the center of contact head 77 and the attachment point of the positive catch 65 at projection 67 having different distances to the mechanical longitudinal axis 81.

The fixed contact element 29 is formed by an almost square-shaped sheet-metal part 85 having a rivet head 87. Simultaneously, the sheet-metal part 85 forms a terminal pin 31 or, in a twin relay as illustrated in FIG. 6, a common contact element 86 to the rivet head 87 in the second relay. The fixed contact element 29 or a common contact element 86 forming a bridge to the rivet head 87 is inserted into a pocket 79, 79' encompassing the edges of sheet-metal part 85, 85'.

The twin relay 89 illustrated in FIG. 6 is equipped with two combs 23 of mirror-image design and two different types of contact springs 27. The spring parts 80 with spring foot 73, catch projection 67 (compare FIG. 5) and head part 83 are in fact identical, but the contact head 77 is arranged in one of the springs on the side on which the spring foot 73 is bent outwardly, and in the second spring it is located on the opposite side. Due to the correspondingly shaped clamping regions 71 in the carrier part 33, the same contact spring 23, but with head rivets arranged differently or shaped symmetrically, can be inserted in both relays, functioning as both working contacts as well as resting contacts.

The problem of air and leakage paths between the contact elements 27, 29 of adjacent contacts is resolved in the same manner within each individual relay of the twin relay, as in the case of a single relay. A leakage path between the contact springs 27 or the fixed contact elements 29 of the load contacts 91 of at least 8 mm inside the relay results from the path extensions by means of overlapping chamber walls 47 and chamber ribs 53 and by shields 59. The distance of the pins and the air path on the inside under load contacts 91 amount to at least 6.5 mm and fulfill the requirements of the standards. Between the load contacts 91 and the control contacts 93, the air path is extended to 8 mm. This ascertains a reliable separation between the different voltage potentials of the load contacts 91 and the control contacts 93 operated with safety low voltage.

In addition, in the case of a twin relay 89, both relays must be arranged at a distance from one another, which fulfills the requirements of the standards. For this purpose, between the two relays a labyrinthine gearing of cover 43 and carrier part 33 is provided, on the one hand, and of bottom part 45 and carrier part 33, on the other hand, the labyrinth gearing being attached to a carrier part 33 designed for two drives 15 (compare FIG. 2) and two rows of contacts 25. The walls provided in the carrier part 33 for this gearing are penetrated only by the common contact elements, so called bridges 86 common to two contacts 25 forming bridges, and the chamber ribs 53 adjacent to these.

For a relay 11, whether an individual relay or a twin relay, a carrier part 33 preferably cast of plastic, encloses a drive on one side of a separating wall and forms chambers 49 for contacts 25 on the other side of the separating wall. The chambers 49 are open on the side lying opposite the separating wall and are closed by a bottom part 45. A comb 23 which is movable parallel to the separation wall by an armature is arranged between the bottom part 45 and the contacts 25. Movable contact springs 27 of the contacts 25 cross the comb 23 and are forcibly commutated by means of the comb. The contact springs 27 are all designed uniformly, and will be moved by comb 23 equally on either side. The combs 23 are also designed uniformly, and the movable heads of contact springs 27 are arranged equally on either side of comb 23. The components of the relay are particularly advantageous for the production of a twin relay. Due to the arrangement of the comb 23 near the bottom, the contact springs 27 can be aligned before the comb 23 is inserted. Thus, relay 11 may be produced with contact springs of very small dimensions and can be adjusted in a reliable operating manner. Sufficiently long leakage and air paths are achieved between the contact elements 27, 29 in adjacent chambers 49 even though only small spaces are available. This advantage is a result of the constructive engagement of the bottom part 45 with chamber ribs 53 and carrier part 33 with the chamber walls 47. The distances of the terminal pins from one another and the number of contacts 25 are decisive factors for the overallexternal dimensions of relay 11. The length of the contact springs 27 with respect to the minimal distances between the contact heads of an open contact 25 is a limiting factor, since the material nature of the contact spring 27 can be varied only within certain limits. Due to the extension of the coil 37 (compare FIG. 2) over the entire length of all chambers 49, it can be operated with the lowest possible power losses.

While the invention has been described above with reference to specific embodiments thereof, it is apparent that many changes, modifications, and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A safety relay comprising:

a separating wall;

an electromagnetic drive located on a first side of said separating wall comprising:

a coil with core and yoke, the coil being connectable to a control current, the core being oriented parallel to said separating wall; and a movable armature;

a comb located on a second side of said separating wall movable parallel to said separating wall by means of said armature; and a plurality of contacts positioned in a row and located on said second side of said separating wall actuated by said drive and comb, each of the contacts comprising at least two contact elements arranged on an electrically insulating carrier part each of the contact elements being connected with a current connection element, at least one of said contact elements being formed by an elongated contact spring arranged between said comb and said separating wall, and said contact spring sitting rigidly in said carrier part by a spring foot and being arranged with a spring longitudinal axis crosswise to the direction of the movement of said comb and being forcibly guided by said comb, said contact spring being provided with a contact head at the end lying opposite said spring foot, said end being movable.

2. The safety relay of claim 1, wherein on a contact spring having a side facing a contact member of the contact and an opposite side turned away from said contact member a contact head is formed on both of said sides of said contact spring.

3. The safety relay of claim 1, wherein contact chambers are formed between the separating wall and a removable outer contact chamber wall, the removable outer contact chamber wall closing the contact chamber on a comb side opposite the separating wall.

4. The safety relay of claim 3, wherein the totality of chambers for said contacts actuated by one electromagnetic drive have practically the same dimensions in two directions as said coil assigned to said contacts, so that the chambers and the coil take up the same area.

5. The safety relay of claim 3, wherein said chamber walls or ribs are formed form said carrier part and said chamber outer wall.

6. The safety relay of claim 1, wherein said contact springs have a projection directed away from the separating wall towards a comb for engagement with the comb, the projection being placed between spring foot and contact head.

7. The safety relay of claim 6, wherein said contact spring has a mechanical longitudinal axis (extending from its foot to the contact head), and said comb being engaged with said projection of the contact spring in a first distance to said mechanical longitudinal axis.

8. The safety relay of claim 7, wherein said contact head is attached to said contact spring by its center and at a second distance to the mechanical longitudinal axis of said contact spring, said second distance being smaller than the first distance between said comb attachment place and said mechanical longitudinal axis in said contact spring.

9. The safety relay of claim 6, wherein the first distance in direction of said longitudinal axis of the contact spring between a comb attachment place on the projection and the spring foot is double the second distance between said comb attachment place and the center of said contact head.

10. The safety relay of claim 1, wherein individual contacts are separated from one another by chamber walls.

11. The safety relay of claim 10, wherein said comb has a longitudinal bar guided through cutouts in said chamber walls and shields are arranged parallel to said chamber walls on said bar projecting over said longitudinal bar on at least three sides for extending air and leakage paths between said contact elements of adjacent contacts.

12. The safety relay of claim 11, wherein an engagement place on said comb is engaged with said contact spring is placed at a distance to the longitudinal axis of said longitudinal bar of said comb parallel to the longitudinal axis of said contact spring.

13. The safety relay of claim 11, wherein said comb is formed symmetrically to a plane through said longitudinal axis of said longitudinal bar lying perpendicular to said separating wall.

14. A safety relay according to claim 1, comprising:

a second electromagnetic drive located on said first side of said separating wall comprising:

a second coil with core and yoke, the coil being connectable to a control current, the core being oriented parallel to said separating wall, and a second movable armature;

a second comb located on said second side of said separating wall capable of moving independent from the first comb parallel to said separating wall by means of said second armature, and a second row of several contacts located on said second side of said separating wall actuated by said second drive and comb, the contacts comprising at least two contact elements arranged on said electrically insulating carrier part and being connected or connectable with a current connection element, at least one of said contact elements of each contact being formed by an elongated contact spring arranged between said second comb and said separating wall, and said contact spring sitting rigidly in said carrier part by a spring foot and being arranged with a spring longitudinal axis crosswise to the direction of the movement of said second comb and being forcibly guided by said second comb, said contact spring being provided with a contact head at the end lying opposite said spring foot, said end being movable.

15. The safety relay of claim 14, wherein a common contact element with two contact heads forms a connection between one of said contact elements of one of said contacts in one row and one of the contact elements of one of said contacts in the other row.

16. The safety relay of claim 15, wherein the contacts in one row and the other row now being connected to each other, the contacts each having one current connection element only, are arranged on an end of the relay opposite said armatures.

17. The safety relay of claim 15, wherein said spring feet of said contact springs of said contacts being forcibly guided by said combs and connected by a common contact element are arranged at ends of the contact springs turned away from one another and said contact heads are arranged between said spring feet at ends of said contact spring turned toward one another.

18. The safety relay of claim 15, wherein a clamping region for each contact spring is formed in the carrier part, said spring foot of said contact spring sitting rigidly in said clamping region; and said clamping region being formed symmetrically.

19. The safety relay of claim 14, wherein at least one of said contacts has two current connection elements.

* * * * *